US007954171B2

(12) United States Patent
Horn

(10) Patent No.: US 7,954,171 B2
(45) Date of Patent: Jun. 7, 2011

(54) AIRVEST IMPROVED RETENTION AND FLOW OF REFRIGERATED AIR

(76) Inventor: Stephen T. Horn, White Stone, VA (US)

( * ) Notice: Subject to any disclaimer, the term of this patent is extended or adjusted under 35 U.S.C. 154(b) by 888 days.

(21) Appl. No.: 10/926,914

(22) Filed: Aug. 26, 2004

(65) Prior Publication Data

US 2005/0055753 A1 Mar. 17, 2005

Related U.S. Application Data

(60) Provisional application No. 60/503,163, filed on Sep. 15, 2003.

(51) Int. Cl.
*A41D 13/00* (2006.01)

(52) U.S. Cl. ..... 2/69

(58) Field of Classification Search ..... 2/456, 2.15, 2/69, 81, 102, DIG. 1; 62/259.3, 385
See application file for complete search history.

(56) References Cited

U.S. PATENT DOCUMENTS

| | | | |
|---|---|---|---|
| 2,052,869 | A | 9/1936 | Coanda |
| 5,255,390 | A | 10/1993 | Gross et al. |
| 5,353,605 | A | 10/1994 | Naaman |
| 5,438,707 | A | 8/1995 | Horn |
| 5,533,354 | A | 7/1996 | Pirkle |

*Primary Examiner* — Tejash Patel

(57) ABSTRACT

The proposed invention is a method of cooling the human body using compressed air in the manner described by U.S. Pat. No. 5,438,707 without the necessity of directing the nozzles of the air jets directly at the body. The proposed invention directs the air jets in a parallel manner to the surface of the body thus cooling by both the expansion of the gas and evaporative cooling enhanced by larger contact with said surface of the body. Said air jets also cool by a coanda effect that entraps large amounts of air and pulls it along the surface of the body thus increasing evaporation. The present invention also entraps the cold air within a wind resistant cover replacing the mesh outer cover design.

3 Claims, 1 Drawing Sheet

AIRVEST IMPROVED RETENTION AND FLOW OF REFRIGERATED AIR

The application claims priority to the filing date Sep. 15, 2003 of U.S. Provisional Application Ser. No. 60/503,163. The entire disclosure content of that prior filed, provisional application is hereby incorporated herein by reference.

1. FIELD OF THE INVENTION

The present invention relates to body garments capable of cooling the human body. These garments provide cooling of an individual by utilizing rapid depressurization of compressed gases adjacent the wearer as described in U.S. Pat. No. 5,438,707 issued to Stephen T. Horn on Aug. 8, 1995 but complements and enhances the cooling of the vest with evaporative cooling and eliminates a serious safety issue while using the coanda effect to further increase the evaporative cooling efficiency of the garment without increasing either the volume or pressure of the air used.

2. DESCRIPTION OF THE PRIOR ART

Body garments for the purpose of cooling appear in the patent record taking many shapes and forms. However, the present invention is an air vest that uses the expansion of air as described by Charles law to cool the air where the air is now entrapped and diverted and the coanda effect is used to greatly enhance the evaporative cooling of the depressurized air as it moves across the body of the wearer further eliminating a serious safety defect in direct expansion air vests. The coanda effect is described in U.S. Pat. No. 2,052,869 to H. Coanda. The coanda effect is achieved by the discharge of a small volume of fluid under high velocity from a nozzle having a shaped surface adjacent to it. The stream of fluid (referred to as the "primary fluid") tends to follow the shaped surface and induces surrounding fluid (referred to as the "secondary fluid") to flow with it. The result is a stream of fluid consisting of both the primary and secondary fluids, and a flow-multiplying effect in which of a relatively large amount of secondary fluid is moved by a comparatively small volume of primary fluid.

Although some structural elements of the present invention appear arguably similar to those found in the patent record, the patent record does not show the unique aggregate effect produced in the present invention. For argumentative purposes the prior art is presented as follows.

U.S. Pat. No. 5,438,707 issued to Stephen T. Horn on Aug. 8, 1995 discloses an apparatus that uses the direct expansion of air directed perpendicular to the body to cool the body by the application of Charles Law where a gas drops in temperature as it drops in pressure. This patent does not teach the use of evaporative cooling on the human body or take into account the high humidity levels in the layer of air directly adjacent to the human body. The patent does not teach the use of the already de-humidified air that ordinarily comes from a compressor. Compressed air is dry because the moisture in the air is condensed out upon the sides of the pressure tank normally used with a compressor. There is a valve on the bottom of compressor pressure tanks to drain the condensed water out of the tank periodically. The patent does not teach to direct the flow of air parallel to the body to use of the coanda effect as described in U.S. Pat. No. 2,052,869 to H. Coanda to induce the surrounding air to flow with it; increasing the air flowing across the body and thus increase the amount of moisture removed from the body to the increase the evaporative cooling of the body. The patent does not address the serious safety issue of directing compressed air directly at the body. The air from a standard compressor used to operate air tools is in the range of 100 psi. This is more than adequate to project particles that can penetrate the skin if no method is used to prevent direct contact with the air exit nozzle or reduce the pressure used or direct the flow parallel to the body. The patent does not teach the enclosure of the vented air tubing or body with a wind tight covering to prevent the cooled air from immediately escaping before all the cooling advantage to the body has been expended. Most important the vented wind resistant covering allows moisture to rapidly evaporate due to the large concentration gradient between the the dry atmosphere supplied by the compressor to the saturated air next to the body. This increased mass transfer rate due to the concentration gradient enhanced by the trapped dehumidified air increases the evaporative cooling efficiency of the vest at virtually no cost. The air after absorbation of this saturated layer is then exhausted a loose opening at the neck.

U.S. Pat. No. 5,255,390 issued to Stanford A Gross and Stanley Bauman on Oct. 26, 1993 discloses a apparatus is a gas ventilated garment which is connected through a plurality of gas conduits to various locations to slowly release air adjacent to the body of the wearer. "Individual radial valves are adapted to release the pressurized gas at extremely low rates". In the preferred configuration of the Gross and Bauman invention, the only cooling that is mentioned is in conjunction with the use of a "wicking" garment which will "gather and hold the moisture from perspiration of the user 12 immediately adjacent the skin of this user." Gross makes no discloser in which the garment is described other than a "ventilation garment" yet no vents are taught or shown. No claim is made as to cooling the air around the individual. Importantly no attempt is made to utilize the large concentration gradient between the moist air layer next to the skin and the dry compressed air, for cooling or provide a means to vent the air after it has absorbed moisture. The saturation of the contained air would become uniform after a point little cooling would occur. No provision for back pressure in the system is made. No attempt to capitalize on Charles Law or the coanda effect is made. No safety issues concerning the direct use of compressed gasses on the body is addressed. The system is designed to trap ventilated air, not large scale evaporate cooling nor is there a drop in air temperature. He teaches "Preferably this jacket chamber includes elastic members 62 at the neck and wrists and can also include a drawstring 58 at the waist of a user. In this manner an air chamber will be defined adjacent to the body of a user 12 for retaining of the ventilation gas released through the multiple individual radial dispersion valves 24. This air will accumulate over time." The nylon fabric of the material is designed to trap ventilated air not remove moisture or cool the ambient air around the wearer. No method of venting the air around the user is envisioned especially if a high air flow as is used in cooling, is shown. In fact the air is trapped at the neck and ventilation is very limited. No method of insuring that any back pressure that could take place, would in fact take place outside the apparatus. Thus no cooling of the injected air would take place within the apparatus. No method of dispersal of air around the user through movement of the tubing is described. No consideration of machining nozzles in reinforced tubing is shown. None of the elements of U.S. Pat. No. 5,438,707 are shown or the improvements in the present invention. A frictional heating effect would in fact occur to a small extent if the flow of the radial valves exceeds the ventilation of the garment and the flow of the manifold. There is no teaching of the use of the coanda effect to enhance evaporative cooling.

There is no provision to prevent this because the apparatus is designed to retain the ventilated air not to cool the air or increase evaporative cooling.

U.S. Pat. No. 5,353,605 issued to Chibbi Naaman on Aug. 30, 1993 discloses a cooling headwear to be used on a user's head. The Naaman patent does not teach the use of Charles law to cool the air nor does it teach the use of the coanda effect to increase the cooling by increasing evaporation. The coanda effect is demonstrated when a poring liquid tends to adhere to the side of the glass or pitcher and dribble as it is poured. The coanda effect is a vortex like effect that lets the flow of air cling to a surface and drag other gas along with it. The described invention is limited to cooling the head and face by blowing already cool air on it. No mention is made of how the air is cooled. No method of enhancing the coanda effect is demonstrated. There is no discussion of the saturated layer of moist air next to the skin.

U.S. Pat. No. 5,533,354 issued to Fred Pirkle on Sep. 20, 1994 discloses a cooling harness made with tubing with a fin attachment. The Pirkle patent does not teach the use of Charles law to cool the air. Nor does it teach that the cross sectional area of the inlet to the tubing should be greater than the sum of the exits of the tubing to allow back pressure and the expansion of the gas upon the exit from the apparatus. Pirkle does not teach the use of the body as a surface upon which the coanda effect takes place rather he describes a second surface which is generally a fin cast on the tubing. This fin can be eliminated in the present invention because the coanda effect is used not to increase the volume of air circulated but to also break and mix the saturated surface layer of next to the skin. No mention is made of evaporative cooling in this apparatus. He describes a "means formed as a unit with said tubing and providing a surface adjacent to the perforations, wherein the means for the escape of gas directs escaping gas toward the surface to produce a flow of gas." or a stream of gas flowing toward another stream of gas to improve the flow. No method is shown to cool the gas but rather this invention relies on the ambient temperature of the gas to provide comfort.

3. SUMMARY OF THE INVENTION

U.S. Pat. No. 5,438,707 issued AUG. 8, 1995, describes an airvest that cools by the expansion of air. Such a vest is manufactured as well as complimentary chaps or pants. In its manufacture it is the custom to make the vest from two layers of a mesh material and to insert a tubing network between the layers and then drill holes into the tubing network so that the holes allow air in the network to blow directly on the user and to cool him. It is necessary with this product to have the holes directed at the person because of two reasons primarily. First, the manufacture of the vest requires a method of stabilizing the tubing so the holes can be drilled in an orientation that will not waste air as the air is generally just allowed to escape. They are drilled within the vest, drilling through the first inside layer of mesh and then through the tubing because as they are in pockets and under the vest all the holes will be lined up and none will be directed toward the outside of the vest where it would just blow refrigerated air into the surrounding area and not cool the person at all. Secondly as the present vest is mesh both on the inside and the outside any tubes that have the holes drilled on the side parallel to the body merely vent the cold air to the outside. This design of the vest has a very dramatic side effect. As the holes necessarily have to be drilled perpendicular to the body of the wearer, there is a danger if the present vest is modified to use cheaper materials or a thinner mesh material than presently used that particles of sand or dirt could be injected into the wearer.

Safety regulations require no more than 30 psi be directed toward the skin and with a thin inside mesh as might be used this can be easily exceeded. The present mesh possibly protects against this pressure by its strength, coarseness and thickness as well as the wavy pattern the fibers create and keeps the holes in the tubing off the wearer but in order to use a less expensive material changes to the existing vest are necessary. If a material is used that can seal to the skin like a perforated polyethylene then particles of sand could penetrate the skin.

A case study brings to mention Mitch Peerless of Hartford Conn. who unbeknown to him infected his hand with a sandblaster by pressing his hand to the end of the blast gun. Only after his hand began to swell up days later did he realize he had injected sand into his hand. The resulting infection could have resulted in the loss of his hand.

Present air vests also either use a considerable amount of air or are very inefficient in cooling. Some use evaporative cooling but they fail to control the air flow of air in an efficient manner. The air used for evaporative cooling is typically slow flowing without attention to shaped adjacent surface of the body to it thus ignoring the potential of the coanda effect to enhance cooling through evaporation.

The invention envisioned to correct these cooling efficiency and safety problem is to seal the outside of the vest with a wind resistant covering such as taffeta or a like material. Wind resistant material is any cloth where the space between the threads is proportionally smaller than the threads themselves as compared to a mesh material. A wind resistant material might be a plastic film of some sort. The vest as shown in the U.S. Pat. No. 5,438,707 drawings is vented at the neck, waist, chest and arms and covered with mesh on the outside. Replacing the outside mesh with a taffeta like covering or wind resistant covering would allow the collection of cold air within the vest rather than venting it directly to the outside as is now done. This would allow the tubes to be drilled in a jig separate from the vest and inserted in a way that the air is not vented directly perpendicular to the body for safety considerations. The venting holes in the pressurized tubing could then be aligned slightly between parallel and perpendicular to the surface of the body and in the same direction, perhaps clockwise around the chest, to create a direction of flow of air under the wind resistant surface of the vest. The resulting coanda effect will greatly enhance the cooling effect of the cold dry air venting into the vest by covering a larger surface area of skin disrupting the saturated surface layer of air next to the skin with greater amount of moving dry air and thus encourage further evaporative cooling of the body. The evaporative cooling of the body is accomplished by the phase shift of the water in the form of moisture on the surface of the body by dissolving it into the naturally dry air coming from a compressor. This mass transfer is due to the large concentration gradient between the dry air that is emitted by the air compressor and the saturated air next to the skin. The wind resistant covering allows this to happen rather than just spot cooling a portion of the body and then expelling cold dry air to the surrounding environment. It is envisioned that this would increase the effective cooling of the vest by more than 20% and increase its safety as well as allow for cheaper production.

The coanda effect as previously stated is evident when poring a liquid as it tends to adhere to the side of the glass and dribble is used in the present invention. The coanda effect is a vortex like effect that lets the flow of air cling to a surface and drag other gas along with it. The present invention uses this effect by directing the flow of the major portions of the nozzles drilled into the tubing to vent the pressurized air to be both in the same general direction and generally parallel to the body. This orientation will entrap and drag any other available air with it and enhance the flow of cold air across the body and enhance evaporative cooling.

A further strictly safety enhancement in places where venting the compressed air generally parallel to the surface of the body inconvenient is the incorporation of a deflector device at the ends of the air nozzles that are drilled into the tubes in the airvest as described. The deflector would interrupt the flow of air against the body and direct it toward a more parallel motion and prevent the injection of foreign substances. The deflector could be attached to the tubing or could be attached to the liner of the vest. It could be as simple as a non perforated piece of wind resistant cloth or a molded attachment to the tubing. The idea is to prevent the strong flow and pressure on the skin of the wearer.

4. BRIEF DESCRIPTION OF THE DRAWINGS

5. DETAILED DESCRIPTION OF THE PREFERRED EMBODIMENT(S)

Figure 1:
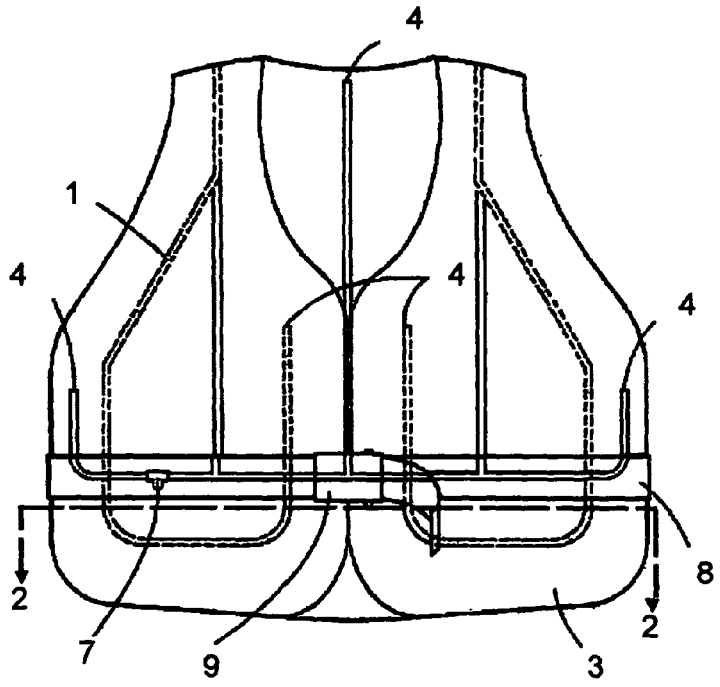
FIG. 1 is a front view of the vest embodiment of the body garment. Tubing in the front panels of the vest are shown in broken lines, tubing in the rear panels of the vest are shown in phantom.

The preferred vest (FIG. 1) would be an air expansion vest with pressurized tubing 1 where the orientation of the pressurized tubing vent nozzles 2 (FIG. 2) or holes and a wind tight 3 covering would allow coanda enhanced evaporative cooling and cooling through the drop in air pressure and consequential drop in the temperature of the cooling air. The pressurized tubes would be capped on the ends 4 (FIG. 1) to maintain back pressure in the tubing. These several significant improvements that in aggregate would significantly change the cooling method by utilizing the natural dryness of compressed air and its ability to phase shift and evaporate the moisture present on the surface of the body 10 (FIG. 2) and markedly increase the efficiency of this vest over others. First the holes 2 (FIG. 2) drilled in the tubes sewn into the vest would be aligned almost parallel to the surface of the body 10 (FIG. 2) rather than perpendicular. The outer shell would be comprised of a flame proof and wind resistant taffeta fabric 3. All holes drilled in the tubing 1 and inside mesh 5 (FIG. 2) would point in the same rotational direction around the body to encourage increased laminar flow 6 (FIG. 2) of gas induced by the coanda effect. The overall increase in the volume of moving gas would enhance the evaporative effect of the apparatus and increase cooling. Gas would enter from a compressed air source not shown into the vest at manifold 7 (FIG. 1) supported by belt 8 (FIG. 1) and exit at the open neck, arm holes, waist, and chest but primarily at the belt buckled closier 9 (FIG. 1) over the chest. Any pants gloves or caps would also be so designed with this improvement.

Referring now in detail to the drawings, FIG. 1 illustrates the vest. A tubing network 1 is incorporated within the vest. Compressed air enters at the back of the vest at manifold 7. The manifold is designed to accept a compressed air line from a compressed air source. Dotted lines indicate the front of the vest, they show the tubing network as it comes over the shoulders and down the front of the vest. Shown in solid line one tube seen through the neck opening goes up the back. The tubing 1 has end caps at the ends of the tubing 4 (caps not shown). There is a belt 8 that goes around the vest over the wind resistant covering 3 to hold it loosely to the body. There is a buckle 9 that is adjustable to hold the belt. Number 2 shows where a cross section of the front of the vest is taken for FIG. 2. The cross section goes from the seam (not shown) joining the front and back of the vest. The opening in the front of the vest that is closed by the belt is also not shown in the FIG. 2 cross section.

Figure 2:
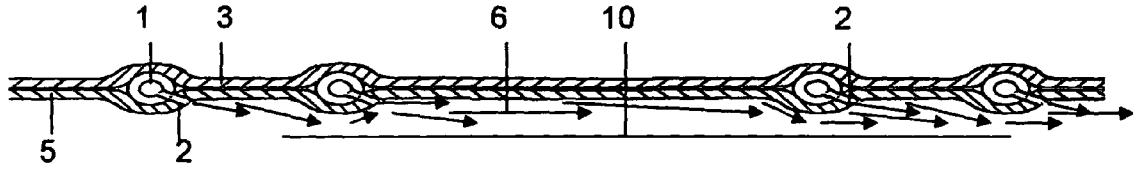
FIG. 2 is a cross-sectional view of the vest embodiment of the garment along the line 2-2 of FIG. 1.

Referring in detail to the drawing cross section FIG. 2 illustrates how the wind resistant covering 3 and the openings in the tubing are orientated to one another. The wind resistant covering 3 is on the outside of the vest. It is seamed (not shown) to the mesh material 5 along the tubing network 1 as well as any open edges such as the neck opening in FIG. 1. Mesh material 5 must be coarse enough to allow the sufficient passage of air flow 6. Openings 2 in the tubing 1 are spaced regularly along the tubing network. The direction of flow is controlled by the angle of openings 2. The angle of opening 2 is shown as between parallel and perpendicular to the body 10 and all openings 2 are in the same general direction to create air flow 6 between the vest and the body 10.

A further description to the preferred embodiment is as follows. The present invention relates to body garments that cool the body. The present invention is distinct from those already patented in that the cooling comes through the coanda effect dragging dry air along the surface of the body and hence evaporating moisture from the body and enhanced by the rapid expansion of a gas exiting from a tubing network 1 (FIG. 1) incorporated into a inside mesh 5 (FIG. 2) and out side wind proof cloth 3 (FIG. 2) body garment 3 (FIG. 1). Pressurized gases above 70 psi, when moved through a preferably 3/16 inch inner diameter, wire reinforced tubing material 1 (FIG. 2), and exiting therefrom through small cylindrical shaped openings 2 (FIG. 2) and 4 (FIG. 1), that are directed in manner and angle to the body to allow the coanda effect to flow air 6 (FIG. 2) along the surface of the body 10 (FIG. 2) where it will drag other air with it to enhance evaporative cooling of the body. The compressed air will expand and dispense rapidly so that the temperature of the air adjacent the body of the individual will be cooled from the cold gas that is, itself, dropping in temperature as it exits the tubing 1 (FIG. 1) through openings 2 (FIG. 2) and expands. The ends of the tubing 4 (FIG. 1) are principally capped to maintain 50 lb back pressure within the tubing network, yet have small cylindrical openings in them and on other places along the tubing network but not to the extent that back pressure more importantly rapid flow cannot be maintained.

Referring now in detail to the drawings, FIG. 1 illustrates the vest embodiment of the inside mesh and outside windproof fabric body garment 3. A tubing network 1 is incorporated within the vest 3, has drilled holes 4 that are spaced longitudinally along tubing 1 that is adjacent to the body of the wearer. Connector 7 is a typical "quick-release" type fastener that accepts a feed line for a system (not shown) that originates at a compressor or compressed air tanks (both, not shown) that supply the compressed gas to the cooling body garment 3, in this case, vest 3. Through connector 7 compressed gases, preferably air or CO2, are passed into cooling vest 3 by tubing 1 at a pressure of at least 70 psi to accomplish minimal air flow and cooling. More effective air flow and cooling occurs when the pressure from the compressor, or tanks, is in excess of 100 psi, but not higher than 200 psi. For enhanced comfort and better fit, vest 3 has a belt member 8 attached along line 2 thereto capable of being adjusted to different sized waists by adjustable buckle means 9.

Referring now to FIG. 2, a cross-sectional view of the vest illustrated in along line 2-2 (FIG. 1) shows the construction of a two layer arrangement of a windproof fabric 3 on the outside and a mesh fabric 5 on the inside of the garment. The body surface 10 of the wearer is shown. The penetrations or cylindrical openings 2 in the tubing 1 are shown not in an absolute vertical orientation to the wearers body surface 10. The flow of air 6 along the wearers body surface is shown. The two both windproof fabric and mesh fabric garment layers are laid one over the other and sewn together along the edges in a manner appropriate in the industry for forming a vest from a combination of front and back panel sections not detailed herein. Stitching, not shown, serves the duel purpose of additional shaping of the vest as well as forming passageways to support and hold tubing 1 within the vest. Hence, the stitching is necessary for creating passageways through which tubing 1 is incorporated within the vest.

For operational purposes the described vest is simply put on and attached to a compressed air source and allow the air to flow under the outer layer around the body and thus cooling the body.

To clarify the specification, rotational direction is used to indicate the direction of laminar flow of air under the wind proof covering and next to the body. In the preferred embodiment, the air under the vest would flow rotationally and circumferential, around the body clockwise or counter clockwise in reference to the axis of the body from the head to the feet. Hence the injection of compressed air under the wind proof covering drags other air that swirls around the axis of the body on the surface of the torso of the body. Conversely, a similar circumferential flow can also be generated if the direction of the preponderance of the exhaust of the compressed air is changed in direction from around the axis of the body to another orientation but of course the arms and head or the legs would practically limit this direction of flow of laminar air. Air flow in any direction parallel to the surface evaporatively cools the body. The volume air flow is larger than just the air exiting the tubing in the vest. The airflow in practice under the vest wind proof covering is therefore in a rotational direction circumferential to the torso of the body.

Note the holes in FIG. 2 number 2 in the drawing, are in the same general angular direction and yet still directing flow both to the body and in a direction that is parallel to the surface of the body. The penetration angle through the wall of the tubing is not perpendicular but slanted in the same general direction in all tubing cross sections thus the laminar flow can be created next to the surface of the body. The arrows show the flow of the dry air that escapes from the tubing and drags other air with it. The holes shown in the cross sectional drawing of the tubing in the vest show an angle of between 25 to 45 degrees of angle from the perpendicular to the body where the air creates a laminar flow on the surface of the body.

One of the important factors in using pressurized air in cooling a person is that it is dry. It is dry because moisture condenses on the sides of any compressed air container be it either a tank or even the delivery hose. The condensed moisture typically pools in the bottom of such containers and the air remains drier than the ambient air before being processed with the compressor. This drier air evaporatively cools better because in can dissolve moisture from the skin more effectively before becoming saturated. Moisture is more rapidly removed from the skin and thus greater thermal transfer takes place than if the dry air were somehow prevented from contact with the body such as happens with some vortex cooled vests. Thus it is important that a mesh fabric be used next to the body of the wearer and the dry air be allowed to evaporatively cool the person. It is also important that a wind proof covering on the exterior of the vest be used to retain the dry air to allow it time until it becomes saturated rather than immediately dispersing the dry air back into the environment.

I claim:

1. A body cooling apparatus for cooling the body of a wearer comprising:

a body garment including a supporting layer of material;

a tubing network having interconnected tubing;

said tubing network supported to said supporting layer of material;

a connector on said tubing network;

a source of pressurized air introduced;

a plurality of openings in said tubing, wherein said plurality of openings have an aggregate total cross-sectional area less than the cross-sectional area of the inner pathway of said tubing so that pressure may be retained within said tubing resulting in expansion and temperature drop of said air escaping from said plurality of openings;

wherein an outer side of said tubing network is covered with a wind resistant covering;

wherein the orientation of said openings in said tubing are non-perpendicular to said body and generally pointing in the same clockwise or counterclockwise direction around the chest of said body thereby creating a flow of air under the wind resistant covering of the vest thus moving a greater amount of air and encouraging further evaporative cooling of the body.

2. A method of cooling a human body comprising:

wearing on said human body a garment;

supporting a tubing network on said garment thereby holding said tubing network adjacent to said human body;

introducing pressurized air into said tubing network;

maintaining pressure of said pressurized air in said tubing network by limiting escape of said pressurized air; allowing said pressurized air to depressurize, escape and expand through holes in said tubing network;

wherein said holes are non-perpendicular to said body and generally pointing in the same clockwise or counterclockwise direction around said body;

covering an outer side of said tubing with a wind resistant covering;

whereby a flow of said air as a primary fluid that induces a secondary flow of ambient air along the surface of said body and thus enhances evaporative cooling of said body thereby creating a flow of air under the wind resistant covering of the vest thus moving a greater amount of air and encouraging further evaporative cooling of the body.

3. A method of cooling a human body comprising:

wearing a garment on said human body;

supporting a tubing network on said garment;

thereby holding said tubing network adjacent to said body;

introducing pressurized air into said tubing network;

maintaining said pressure of air in said tubing network by limiting escape of said air;

allowing said air to escape and expand through holes in said tubing network;

collecting said pressurized air in a container;

condensing moisture out of said air on the sides of said container thus creating dry pressurized air;

conveying said dry pressurized air to said tubing network held by said garment;

allowing escape and depressurization of said conveyed dry pressurized air from said holes in said tubing;

further directing said escape of said conveyed dry air in a clockwise or counterclockwise direction around the chest of said body by use of a wind resistant covering attached to said garment and external to said tubing network, thereby creating a flow of air under the wind resistant surface of the vest thus moving a greater amount of air and encouraging further evaporative cooling of the body;

whereby the moisture concentration of said conveyed dry air under said wind resistant covering is less in comparison with the air layer immediately adjacent to the skin of said human body, such that said conveyed dry air increases evaporative rate from said air layer immediately adjacent to the skin to said escaped conveyed dry air thereby increasing evaporative cooling of said body.

* * * * *